US009340219B2

(12) United States Patent
Gamache et al.

(10) Patent No.: US 9,340,219 B2
(45) Date of Patent: May 17, 2016

(54) WAYSIDE MEASUREMENT OF RAILCAR WHEEL TO RAIL GEOMETRY

(71) Applicant: International Electronic Machines Corporation, Troy, NY (US)

(72) Inventors: Ronald W. Gamache, East Greenbush, NY (US); Zahid F. Mian, Loudonville, NY (US); Jeremy C. Mullaney, Clifton Park, NY (US)

(73) Assignee: International Electronic Machines Corp., Troy, NY (US)

( * ) Notice: Subject to any disclaimer, the term of this patent is extended or adjusted under 35 U.S.C. 154(b) by 0 days.

(21) Appl. No.: 14/589,563

(22) Filed: Jan. 5, 2015

(65) Prior Publication Data

US 2015/0115109 A1 Apr. 30, 2015

Related U.S. Application Data

(63) Continuation of application No. 13/901,055, filed on May 23, 2013, now Pat. No. 8,925,873.

(60) Provisional application No. 61/688,910, filed on May 24, 2012.

(51) Int. Cl.
*B61K 9/00* (2006.01)
*B61K 9/12* (2006.01)

(52) U.S. Cl.
CPC ..... *B61K 9/12* (2013.01)

(58) Field of Classification Search
USPC ..... 246/169 D, 169 R, 169 A; 356/601, 602, 356/604, 612, 613, 3.01, 635; 250/559.22, 250/559.23, 559.24
See application file for complete search history.

(56) References Cited

U.S. PATENT DOCUMENTS

| | | | | | |
|---|---|---|---|---|---|
| 4,798,963 | A | * | 1/1989 | Wittkopp et al. | 250/559.22 |
| 4,798,964 | A | * | 1/1989 | Schmalfuss et al. | 250/559.22 |
| 4,932,784 | A | * | 6/1990 | Danneskiold-Samsoe | 356/602 |
| 5,193,120 | A | * | 3/1993 | Gamache et al. | 382/286 |
| 5,368,260 | A | | 11/1994 | Izbinsky et al. | |
| 5,636,026 | A | * | 6/1997 | Mian et al. | 356/602 |
| 5,936,737 | A | * | 8/1999 | Naumann | 356/613 |

(Continued)

FOREIGN PATENT DOCUMENTS

| | | |
|---|---|---|
| EP | 2402227 | 1/2012 |
| JP | 2003240516 | 8/2003 |
| WO | 02097365 | 12/2002 |

OTHER PUBLICATIONS

Walker, Andrew, Australian Examination Report, Application No. 2013266210, Apr. 29, 2015, 3 pages.

(Continued)

*Primary Examiner* — Jason C Smith
(74) *Attorney, Agent, or Firm* — LaBatt, LLC

(57) ABSTRACT

Considerable damage to rails, wheels, and trucks can result from geometric anomalies in the wheelsets, rails, and truck hardware. A solution for identifying and quantifying geometric anomalies known to influence the service life of the rolling stock or the ride comfort for the case of passenger service is described. The solution comprises an optical system, which can be configured to accurately perform measurements at mainline speeds (e.g., greater than 100 mph). The optical system includes laser line projectors and imaging cameras and can utilize structured light triangulation.

20 Claims, 8 Drawing Sheets

(56) References Cited

U.S. PATENT DOCUMENTS

| | | | | |
|---|---|---|---|---|
| 6,381,521 | B1 | 4/2002 | Dembosky et al. | |
| 6,768,551 | B2 * | 7/2004 | Mian et al. | 356/446 |
| 6,909,514 | B2 * | 6/2005 | Nayebi | 356/601 |
| 7,032,740 | B2 * | 4/2006 | Hochhaus et al. | 198/502.1 |
| 7,152,347 | B2 * | 12/2006 | Herzog et al. | 37/195 |
| 7,287,334 | B2 * | 10/2007 | Moffett et al. | 33/203.18 |
| 7,525,667 | B2 * | 4/2009 | Mian et al. | 356/601 |
| 7,564,569 | B2 * | 7/2009 | Mian et al. | 356/601 |
| 7,701,591 | B2 * | 4/2010 | Mian et al. | 356/601 |
| 7,707,944 | B2 * | 5/2010 | Bounds | 104/5 |
| 7,714,886 | B2 * | 5/2010 | Kilian et al. | 348/135 |
| 7,715,026 | B2 * | 5/2010 | Nayebi | 356/625 |
| 7,975,540 | B2 * | 7/2011 | Angell et al. | 73/146 |
| 8,006,559 | B2 * | 8/2011 | Mian et al. | 73/643 |
| 8,140,250 | B2 * | 3/2012 | Mian et al. | 701/117 |
| 8,150,105 | B2 * | 4/2012 | Mian et al. | 382/104 |
| 8,289,526 | B2 * | 10/2012 | Kilian et al. | 356/601 |
| 8,335,606 | B2 * | 12/2012 | Mian et al. | 701/29.1 |
| 8,583,313 | B2 * | 11/2013 | Mian | 701/28 |
| 8,649,932 | B2 * | 2/2014 | Mian et al. | 250/316.1 |
| 8,655,540 | B2 * | 2/2014 | Mian et al. | 701/29.1 |
| 8,781,655 | B2 * | 7/2014 | Landes et al. | 701/19 |
| 2003/0072001 | A1 * | 4/2003 | Mian et al. | 356/446 |
| 2007/0268131 | A1 * | 11/2007 | Kilian et al. | 340/540 |
| 2013/0313372 | A1 * | 11/2013 | Gamache et al. | 246/169 D |
| 2013/0313433 | A1 * | 11/2013 | Mian et al. | 250/338.4 |

OTHER PUBLICATIONS

Notice of Acceptance, Australian Application No. 2013266210, Aug. 13, 2015, 2 pages.

Ahn Jae Yul, International Search Report and Written Opinion for PCT/US2013/042420, Aug. 27, 2013.

Notice of Allowance for U.S. Appl. No. 13/901,055, Sep. 2, 2014, 14 pages.

* cited by examiner

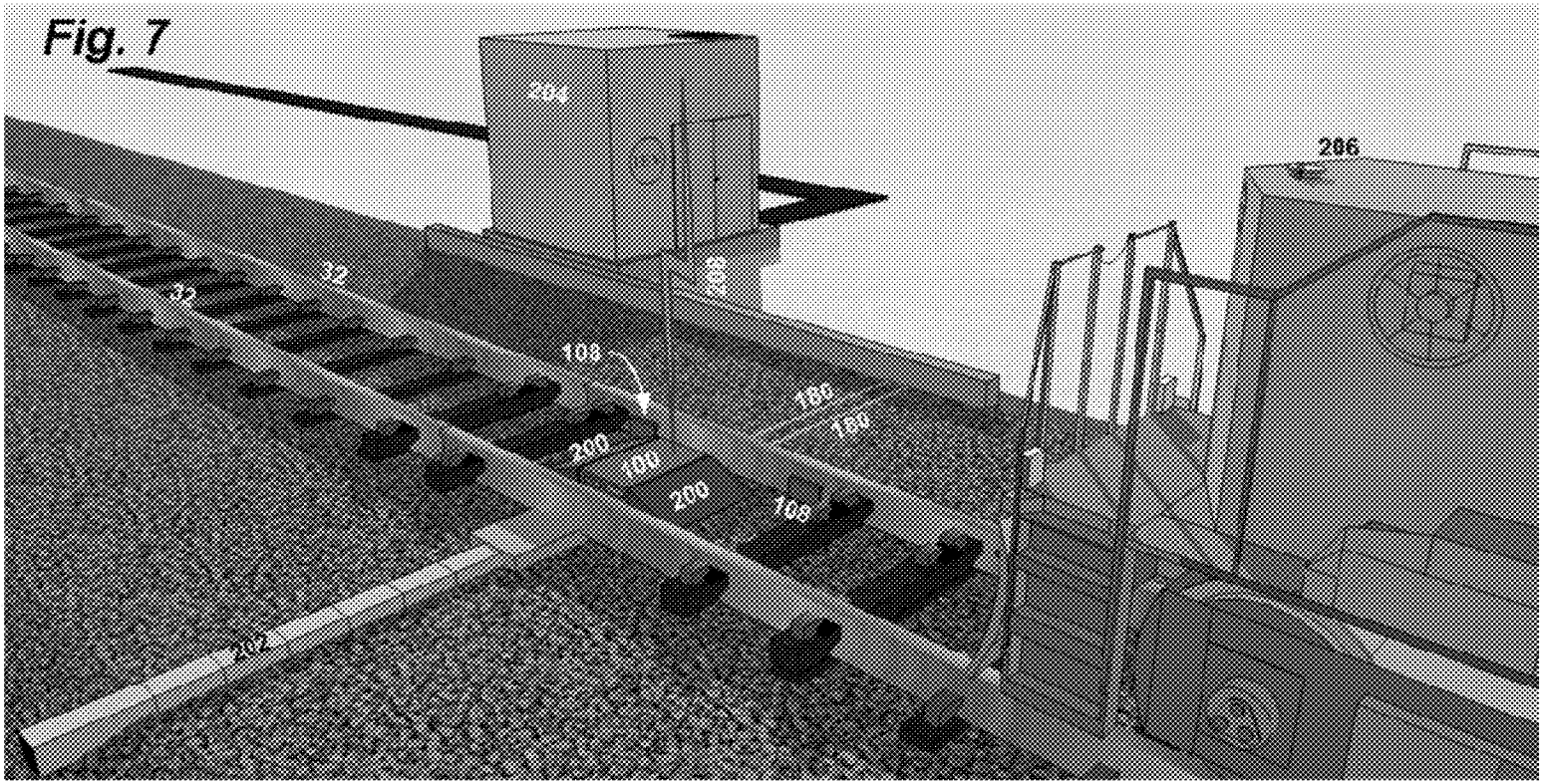
286
206
208
100
100
100

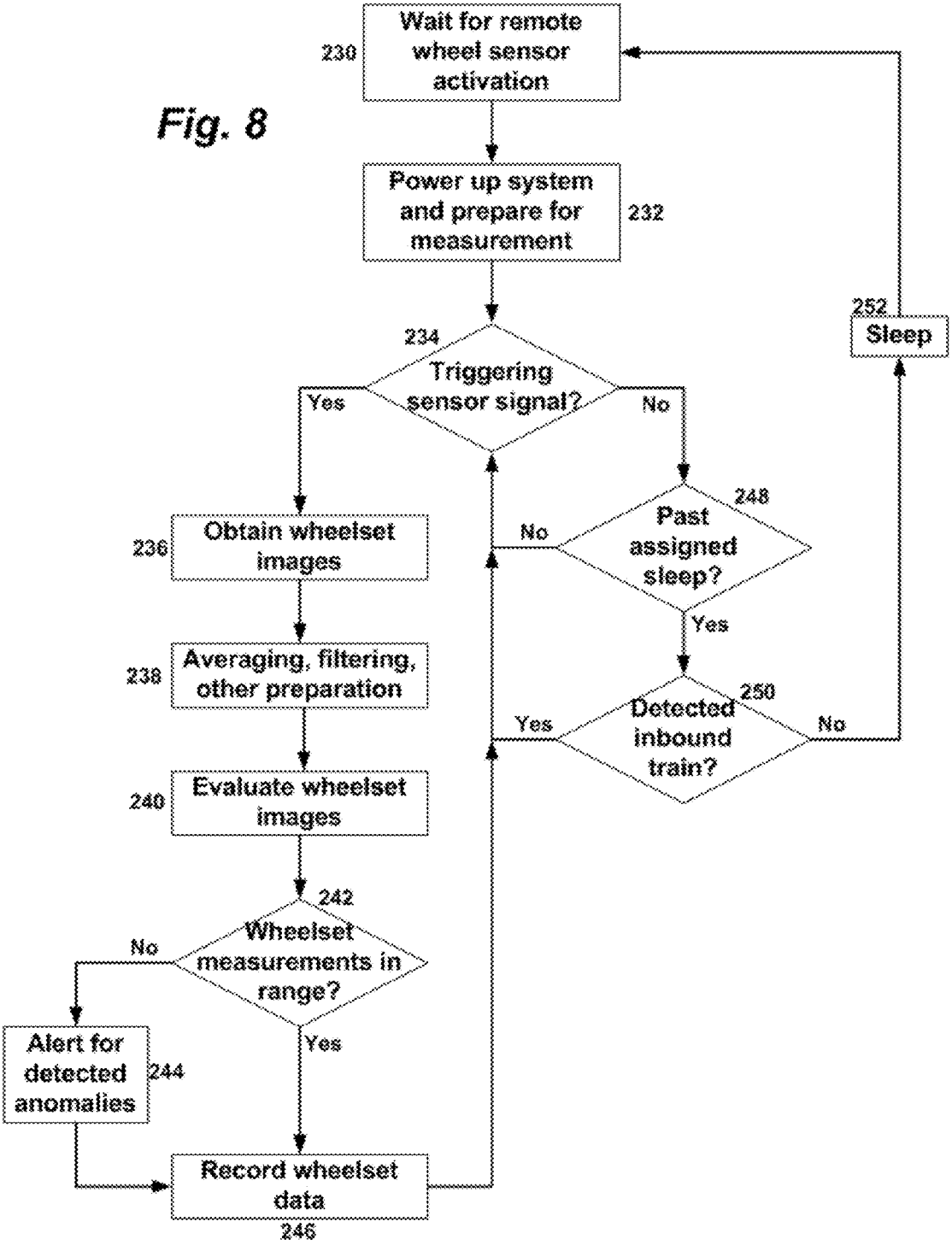
Fig. 8
230
Wait for remote wheel sensor activation
Power up system and prepare for measurement
232
234
Triggering sensor signal?
Yes
No
236
Obtain wheelset images
238
Averaging, filtering, other preparation
240
Evaluate wheelset images
242
Wheelset measurements in range?
No
Yes
Alert for detected anomalies
244
Record wheelset data
246
248
Past assigned sleep?
No
Yes
250
Detected inbound train?
Yes
No
252
Sleep

WAYSIDE MEASUREMENT OF RAILCAR WHEEL TO RAIL GEOMETRY

REFERENCE TO PRIOR APPLICATIONS

The current application is a continuation of U.S. patent application Ser. No. 13/901,055, filed on 23 May 2013, and issued as U.S. Pat. No. 8,925,873, which claims the benefit of U.S. Provisional Application No. 61/688,910, titled "Method and Device for Wayside Measurement of Railcar Wheel to Rail Geometry," which was filed on 24 May 2012, each of which is hereby incorporated by reference.

TECHNICAL FIELD

This disclosure relates generally to the field of rail transportation, and more particularly, to determining a condition of a railcar wheelset and/or truck that may indicate an unsafe condition of the railcar wheelset and/or truck.

BACKGROUND ART

In railway service, rails are nominally parallel with a known elevation and a known cant with respect to a horizontal plane. Railcar wheelsets are mounted in pairs on a suspending device referred to as a truck (also called a bogie). Minimum wear on components and maximum ride comfort occurs when the wheelsets are centered on the rail with axes of rotation perpendicular to the rail centerline; any deviation from this alignment and orientation introduces vibration and results in increased wear.

Several basic measures of misalignment have been related to reduced component life and ride comfort, including angle-of-attack (AOA), tracking position (TP), shift, inter-axle misalignment, and rotation. A primary measure, AOA, is defined, from a measurement point of view, as the angle between the plane containing the rim face of a railcar wheel and a tangent line to the rail on which the wheel is engaged. TP is defined as the transverse displacement of the centerline of the wheelset from the centerline of the rail pair. Additional derived measurements related to AOA and TP are made to identify particular anomalies that have been correlated to reduced component life and ride comfort. The measurements assess the translational and rotational misalignments between the two axles on a truck, and between the axles and the rails. Finally, hunting is a term describing periodic transverse motion of the railcar on the track that may, in severe cases cause resonant oscillation, which results in the wheel flanges impacting the rail. This condition can result in rapid component wear and serious ride comfort issues. Serious truck geometry errors can even result in derailment, especially when operating at high speed and when cornering, causing considerable damage and potential loss of life. Thus an accurate and timely measurement of truck alignment errors can result in reduced maintenance costs and possible prevention of catastrophic derailments.

In general, two technologies have been applied to measure truck related geometry anomalies. In a first approach, strain gauges are mounted to the rail to measure the vertical and lateral forces. In this approach, the ratio of the lateral force to the vertical force is indicative of wheelset misalignment. Such a system, however, requires expensive and time consuming changes to the track infrastructure. For example, installation of strain gauges on a track typically requires grinding the rail and the placement of concrete sleepers to properly support the section of track for accurate strain measurement. If the instrumented rail sections are changed out, the system functionality will be lost.

In a second approach, a wayside optical system comprising a laser beam and an optical detector in conjunction with a wheel detector is used to make the measurements using the principle of optical triangulation. In this case, a point laser displacement measure device is used, which may measure 10,000 points/sec on the field side rim face of a passing wheel.

Unfortunately, this approach is only robust for new, good-condition wheels. In particular, the laser is typically applied at an elevation of approximately one inch above the rail. For good-condition wheels, this allows a continuously measurable section of rim face of about ten inches (or at 10 k points per second at 60 mph, about 110 points). However, as the wheel wears, the rim face becomes more and more narrow, resulting in two separated measurement regions which become smaller as the wheel continues to wear. For the worst case of a condemnable wheel, only 5 data points will be produced for a train speed of 60 mph. As the corners of the rim face may be contaminated with debris, dirt, snow, ice, or the like, inconsistent measurements may result, especially in the case of the more worn wheels for which the measurements have less redundancy to allow for the elimination of outliers.

Another significant limitation of this approach derives from the fact that the measured points are in a time-sequence along a moving object. As there are modes of movement of the wheels in which the alignment of the wheel will vary throughout a complete revolution, this method of measurement may be confused or at least rendered less accurate through variations in the wheel orientation over time.

In a variant of the second approach, proximity sensors, such as inductive sensors, are attached to the rail to measure the duration and relative timing of the signal generated by the passing wheels. By employing two sensors, one on each rail, the angle of attack and other truck performance parameters may be measured. This approach is sensitive to the diameter, speed, and condition of the surfaces of the wheel at the point of detection. In particular, proximity sensors are known to have response variations to all of these conditions, and any variation in response can result in an incorrect measurement of the target parameters.

SUMMARY OF THE INVENTION

The invention described herein utilizes a wayside optical system to make truck alignment measurements in a way that can address one or more limitations and potential error sources in the prior art.

An embodiment can acquire all data required to make a measurement simultaneously (as opposed to over a period of time) to eliminate errors associated with wheelset transverse and/or angular motion that may occur when measurements are made over a more extended period of time.

An embodiment can provide, within the acquired data, a reference to the rail tangent line, reducing the need for labor intensive alignment and calibration procedures at installation and periodically during operation.

An embodiment can acquire sufficient data points over an extended portion of a wheel so as to be insensitive to isolated surface anomalies that may be present on the wheel due to normal use.

An embodiment can mitigate the effects of the wake of dust/snow that may result from a train passing at high speed.

An embodiment can prevent accidental injury to the eyes of railway maintenance personnel or other persons that may be in the path of the operating invention by utilizing laser power levels classified as eye safe under all conditions.

A first aspect of the invention provides a system for evaluating a railcar wheelset for rail alignment, the system comprising: a plurality of structured light measuring devices configured to measure a set of features of opposing wheels on the railcar wheelset as the wheels travel along a rail, a structured light measuring device including: a set of laser line projectors configured to illuminate a portion of a wheel rim surface of a wheel and a portion of a rail head surface of the rail with a sheet of light having an orientation which is substantially vertical and orthogonal to the rail; and a high speed camera configured to acquire image data of the laser light scattered by the wheel and rail; means for automatically determining when to acquire the image data using at least one of the plurality of structured light measuring devices and automatically activating the at least one of the plurality of structured light measuring devices; and a computer system configured to process the image data by performing a method comprising: forming Cartesian coordinates of a plurality of image data points on the wheel rim surface and the rail head surface; and converting the Cartesian coordinates into a plurality of wheel alignment measures, wherein the plurality of wheel alignment measures include an angle of attack and a tracking position.

A second aspect of the invention provides a method for evaluating a railcar wheelset for rail alignment, the method comprising: projecting a plurality of laser lines substantially vertical and orthogonal with respect to a plurality of rails, wherein the projecting is configured such that each of the plurality of laser lines illuminates a portion of a rim surface of a railroad wheel of the railcar wheelset as the wheelset travels along the plurality of rails and a portion of a corresponding rail of the plurality of rails, and wherein at least two laser lines illuminate at least two distinct portions of the rim surface of each of the plurality of railroad wheels of the railcar wheelset; acquiring image data for the plurality of railcar wheels during the projecting; processing the image data to at least one of: reduce noise in the image data or remove outlier points from the image data; for each of the plurality of railroad wheels: deriving three dimensional space coordinates of a plurality of image data points corresponding to the at least two distinct portions illuminated by the laser lines using the processed image data; fitting a plane to the three dimensional space coordinates; comparing an alignment of the fitted plane with a plane of the corresponding rail; and determining whether the alignment of the fitted plane is within an acceptable variation parameters for wheel alignment with the rail; and determining whether any of a set of wheelset alignment conditions is present based on the wheel alignment for each of the plurality of wheels of the wheelset.

A third aspect of the invention provides a system comprising: an imaging component located adjacent to a location of a pair of rails, wherein the imaging component includes a plurality of structured light measuring devices configured to concurrently acquire image data for opposing wheels on a railcar wheelset as the wheels travel along the pair of rails, a structured light measuring device including: a set of laser line projectors configured to illuminate at least two distinct portions of a wheel rim surface of a wheel and a corresponding at least two distinct portions of a rail head surface of the rail with a sheet of light having an orientation which is substantially vertical and orthogonal to the rail; and a camera configured to acquire image data of the laser light scattered by the wheel and rail from both of the at least two distinct portions; and a computer system configured to process the image data by performing a method comprising: for each of the opposing wheels: deriving three dimensional space coordinates of a plurality of image data points corresponding to the at least two distinct portions illuminated by the laser lines from the image data; and fitting a plane to the three dimensional space coordinates; and calculating a plurality of wheel alignment measures for the railcar wheelset, the wheel alignment measures including an angle of attack and a tracking position.

Other aspects of the invention provide methods, systems, program products, and methods of using and generating each, which include and/or implement some or all of the actions described herein. The illustrative aspects of the invention are designed to solve one or more of the problems herein described and/or one or more other problems not discussed.

BRIEF DESCRIPTION OF THE DRAWINGS

These and other features of the disclosure will be more readily understood from the following detailed description of the various aspects of the invention taken in conjunction with the accompanying drawings that depict various aspects of the invention.

FIG. 7 shows an illustrative representation of an embodiment in operation in a railroad setting.

FIG. 8 shows a flowchart illustrating operation of an embodiment.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide a solution for identifying and quantifying geometric anomalies known to influence the service life of the rolling stock or the ride comfort for the case of passenger service. The solution comprises an optical system, which can be configured to accurately perform measurements at mainline speeds (e.g., greater than 100 mph). The optical system includes laser line projectors and imaging cameras and can utilize structured light triangulation. As used herein, unless otherwise noted, the term "set" means one or more (i.e., at least one) and the phrase "any solution" means any now known or later developed solution.

Figure 1:
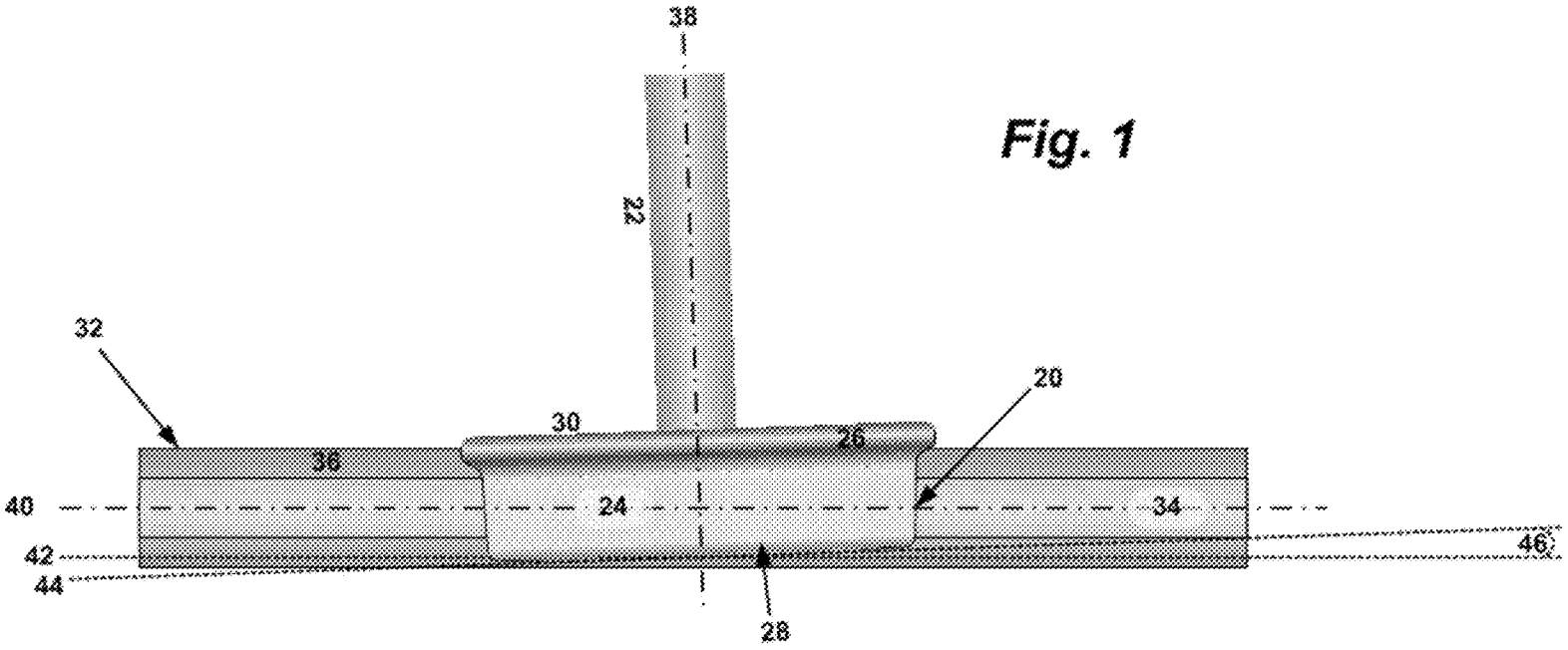
FIG. 1 illustrates wheel to rail geometry showing the angle of attack.

Turning to the drawings, FIG. 1 illustrates wheel to rail geometry showing the angle of attack. In FIG. 1, a wheel 20 is attached to an axle 22. The wheel 20 has key components including a tread 24, a flange 26, a field side 28 and a gauge side 30. The wheel 20 runs on its tread 24 on rail 32. The rail includes a rail head or top 34 and a rail base 36. The rail head 34 and rail base 36 are connected by a "web" section which is not visible in FIG. 1.

In any event, a set of wheels 20 and rails 32 are designed such that during normal operation the axis of rotation 38 (nominally the centerline of the axle 22) of the wheel 20 is nominally perpendicular to the centerline 40 of the rail 32.

Maintaining this geometry minimizes wear and operational drag between the components. As the axle 22 and wheel 20 are rigidly connected (unlike in many other vehicles, such as passenger cars) and thus wheels 20 at either end of the axle 22 cannot turn independently, any misalignment will cause at least some drag rather than turning of the wheels. Sufficient angles of misalignment could cause direct friction between the wheel flange 26 and the railhead 34.

Therefore, in normal operation, the field face 28 and/or gauge face 30 will have a nominally parallel facing to the centerline 40 of the rail 32, as illustrated by line 42. If a misalignment occurs, the face 28, 30 of the wheel 20 will depart from this nominal position as shown by line 44, producing an angle 46. This angle 46 is known as the angle of attack or AoA. Ideally, the AoA 46 is zero. Industry sources state that it is desirable to detect changes in the AoA 46 by at most 0.2 degrees, and preferably less, and that the AoA 46 should never exceed three degrees.

Figure 2:
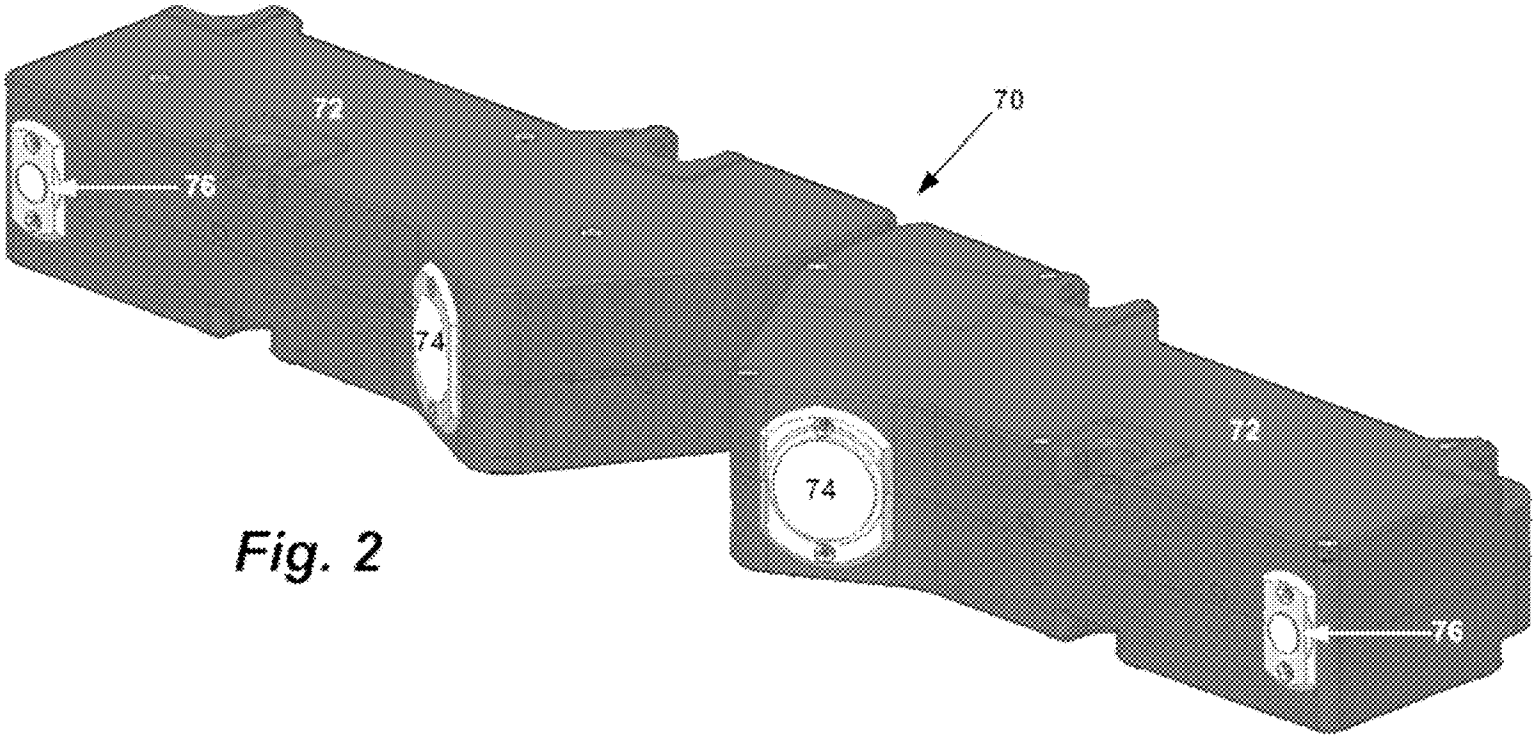
FIG. 2 illustrates an illumination and image capturing component according to an embodiment.

FIG. 2 illustrates an illumination and image capturing component according to an embodiment. The component comprises a structured light measurement system 70, which can include two structured light imaging units 72. The structured light imaging units 72 themselves can include a high-speed imaging unit (camera) 74 and a laser line projector 76. It is understood that this is only illustrative. To this extent, a structured light measurement system 70 can use different numbers of imaging units 72, imaging units 72 of different design, and/or the like. For example, an imaging unit 72 can include more than one laser line projector 76 to project multiple lines, e.g., from different angles, within a field of view of the camera 74. Cameras 74 may be any cameras capable of operating at a sufficient frame rate and sensitivity to acquire the images needed. For example, one acceptable selection for a camera 74 is the Stingray Model F-033, supplied by Allied Vision technologies, which is capable of operation at 366 frames/second for a region of interest of 656×60 pixels. However, it understood that this is only illustrative. The laser line projectors 76 may be any of many vendors' products which produce sufficiently sharp lines at a sufficient intensity.

Figure 3:
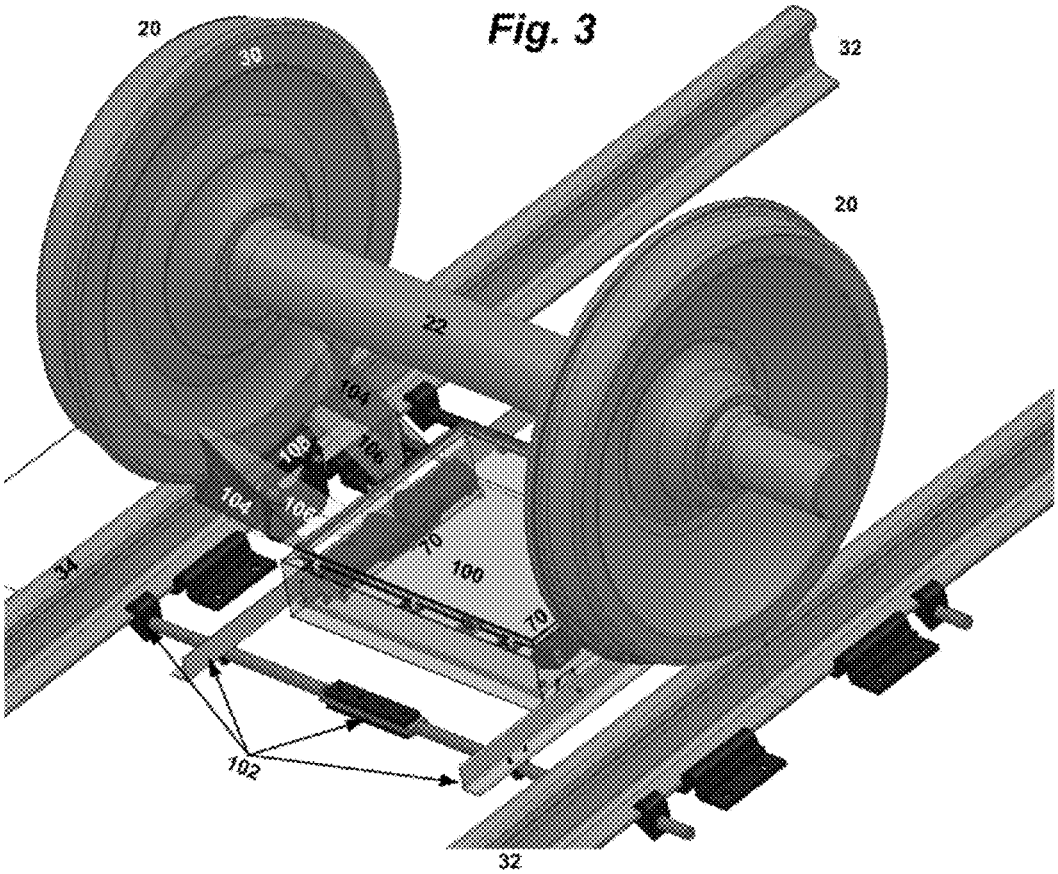
FIG. 3 depicts a portion of an embodiment in use in a railroad setting.

FIG. 3 shows a system view of an embodiment of the invention. The system comprises a component 100 including two structured light measurement systems 70, which is affixed to the rails 32, e.g., by a clamping support 102 or by other means known to those skilled in the art of railroad instrumentation. Two wheels 20 connected by an axle 22 are shown passing over the component 100, riding on the top or head 34 of the rails. This combination of two wheels 20 on an axle 22 is called a wheelset. As the wheels 20 reach an appropriate point, the laser line generators 76 (FIG. 2) can project vertical sheets of light 104 at a nominally perpendicular angle to the rail 32 and gauge face 30 of the corresponding wheel 20. The cameras 74 (FIG. 2) capture an image of a section of the wheel 20, which is within the camera 20's field of view 106. The field of view 106 can be selected such that the vertical laser line(s) 104 is visible within the field of view 106. In an embodiment, a separation of the laser lines 104 in a direction of motion of the wheel 20 is, for example approximately sixteen inches, to result in ideal imaging conditions for typical wheel diameters. The laser line generators 76 may use visible and/or near-infrared light with a power level appropriate for the imaging conditions. In many applications, a power level of approximately 100 mW would be appropriate.

The structured light measurement systems 70 must operate at the proper time to acquire useful images of the wheels 20. In order to achieve this, a standard wheel switch 108 can be attached to the rail 32 at such a location that it can detect passage of the wheel 20 and trigger the structured light measurement systems 70 to obtain the images. While not shown, it is understood that another wheel switch 108 may be placed farther from the component 100 as a "wake up" trigger. This permits the structured light measurement systems 70 to effectively shut down when no trains are nearby, thus conserving significant energy.

In the basic configuration of an embodiment, simultaneous capture of images by cameras 74 is triggered by the wheel switch 108. Due to the simultaneous acquisition of images, and the known geometry between the cameras 74 and lasers 76, the speed and acceleration of the wheels 20 is not required and does not influence the measurement. The methods to obtain full 3-D measurement from the point cloud of laser line 104 points on the wheels 20 as imaged by the cameras 74 are those used for three-dimensional structured light metrology, e.g., as described in U.S. Pat. Nos. 5,636,026 and 6,768,551, both of which are hereby incorporated by reference.

Therefore, with three-dimensional planes determined for the gauge side 30 of the wheels 20 on both sides of the rail 32, an alignment of these planes with the nominally parallel plane represented by the rail 32 can be evaluated, and any misalignment (angle of attack) can be measured accurately.

Figure 4A:
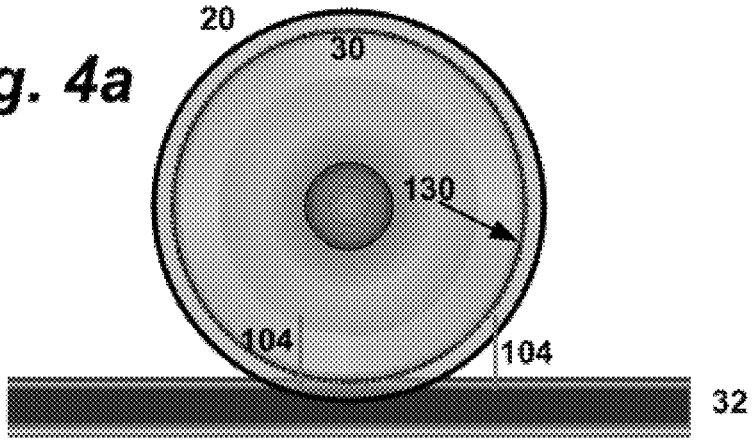
FIGS. 4*a*-4*c* illustrate capture of multiple images in a single pass according to an embodiment.
Figure 4B:
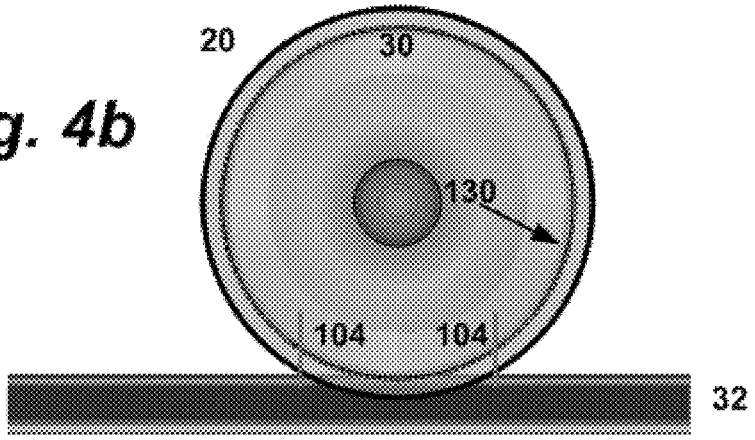
Figure 4C:
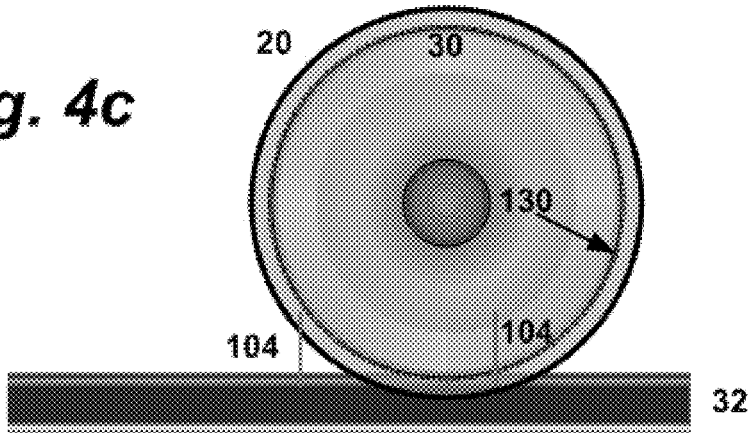

In an embodiment, multiple images may be taken by each camera 74 as the wheel 20 passes. If a wheel 20 is passing the component 100 moving at a speed of 100 mph (1760 inches/sec), and the camera 74 can capture 366 images per second, a properly timed triggering of the camera 74 will permit the capture of at least three usable images of the wheel 20. This is illustrated in FIGS. 4*a*-4*c*. With the above numbers, it is clear that in the interval between each individual image, the wheel will move less than five inches. FIG. 4*a* shows the wheel 20 at the time of initial capture, FIG. 4*b* shows the wheel 20 at the point of the second image capture, and FIG. 4C shows the wheel 20 at the time of the third image capture. If we assume the high-resolution axis of the camera 74 is oriented vertically and has a vertical field of view 106 (FIG. 3) that just encompasses the projected line 104, a scale factor of approximately 100 pixels/inch is obtained. For each of the images captured in the conditions shown in FIGS. 4*a*-4*c*, at least 150 pixels will be visible on the rail 32 and anywhere from 100 to 350 pixels on the rim face 30. Using features in the images, such as the rim break 130, the approach remains insensitive to the speed or acceleration of the wheel 20. The multiplicity of images covering the approximate sixteen inch linear distance on the rim face 30 and rail 32, provides a high degree of insensitivity to local defects or contamination of the imaged surfaces. In addition, multiple images provide a method to detect other variations in wheel presentation. For instance, if the wheel 20 itself is twisted, there will be a clear and detectable change in the apparent AoA 46 (FIG. 1), while in the case of an ordinary AoA 46 (wheelset of two wheels 20 and an axle 22 being set slightly off their nominally parallel mounting) the AoA 46 remains generally constant.

An illustrative required measuring range from industry sources for the AoA 46 is +/−3°. Actual data indicates that the AOA 46 is less than +/−1.72° 98% of the time and less than 0.57° 95% of the time. An illustrative required measurement resolution is 0.2°. This information will determine the required camera resolution (in pixels) to achieve the desired measurement resolution. The structure angle (angle between the camera 74 line of sight and the laser 76 boresight) must be sufficient to allow the measurement to be made accurately. In an embodiment, the angle may be approximately 30°, although other angles may be used for specific effect. As the measurements will be made typically in an open outdoor environment, suitable filters, such as laser line band pass filters, may be utilized on the camera 74 to minimize the effect of stray ambient light on the measurement. The laser power can be selected to provide sufficient illumination on the rail 32 and wheel 20 to produce a usable image on the camera detector under all operational states of the surface of the wheel 20 and rail 32.

An embodiment, of the invention can utilize image processing methods, such as median filtering and ensemble averaging, to reduce the effects of blowing snow or dirt that may be produced by a train passing at high speed. A standard rail heater, such as those from Spectrum Infrared, may be used to melt snow and ice that may be present up to the top of the rail 32 in certain climatic regions at certain times of the year. Raw data from the camera detectors can be processed to produce a multiplicity of centroids in image coordinates by methods taught in the art, e.g., as in U.S. Pat. Nos. 5,636,026, 6,768,551, and 5,193,120. The centroids can be converted into points in a Cartesian <x, y, z> coordinate system that is fixed with respect to the rail again using methods such as taught by U.S. Pat. No. 5,193,120.

A set of points that nominally lie in a vertical plane can be obtained from all the images in <x, y, z> coordinates that were developed from the laser lines 104 projected onto the wheel's rim surface 30. Standard statistical analysis can be used to identify any outlier points that may arise due to anomalies on the wheel surface, such as dings, dents, gouges, deposits, and/or the like. The remaining points can be fitted to a plane using mathematical methods known in the art. The same process can be applied to the image points on the camera detector resulting from the laser line projected on the rail 32. The angle of rotation of the rim face plane about a vertical axis with respect to the plane from the rail head is the desired angle of attack (AOA). Using measurements taken on both wheels 20 of a wheelset combined with the known geometry of the two systems 70, the following measurements can be made. A complete set of the first two measurements can include measurements for the leading (L) and trailing (T) wheelset in the pair, which can be subsequently used for one or more additional measurements:

- Angle of attack (AOA)—orientation of the axle 22 relative to the tracks 32, which can be measured in millradians;
- Tracking Position (TP)—position of the wheelset relative to the track centerline 40 (FIG. 1), which can be measured in mm;
- Inter-axle misalignment—orientation of both axles 22 of a truck in relation to each other, which can be defined as $AOA_L$-$AOA_T$;
- Tracking Error (TE)—difference in tracking positions of the truck axles, which can be defined as $TP_L$-$TP_T$;
- Truck rotation—evaluation of steering ability of the truck, which can be defined as $(AOA_L+AOA_T)/2$;
- Shift—axle shift with respect to the rail center line 40, which can be defined as $(TP_L+TP_T)/2$; and
- Back to back—distance between rim faces 30 on opposite wheels 20 of a wheelset.

All the described measurements can be made with a single component 100.

Hunting is another measurement/evaluation that may be desired. Hunting is the lateral instability of a truck measured as peak axle displacement over a defined distance and can shown in millimeters. Measurement of hunting requires a multiplicity, for example three, of the components 100 located along the rail 32 and separated by a fixed distance, for example, ten feet. The hunting amplitude and wavelength is developed from the TP measurement for each wheel 20 as it passes each of the components 100, e.g., by fitting a sinusoidal curve to the TP data. In order to avoid aliasing, the components 100 can be disposed along the rail 32 such that at least three measurements occur within a single period of the hunting motion.

Figure 5:
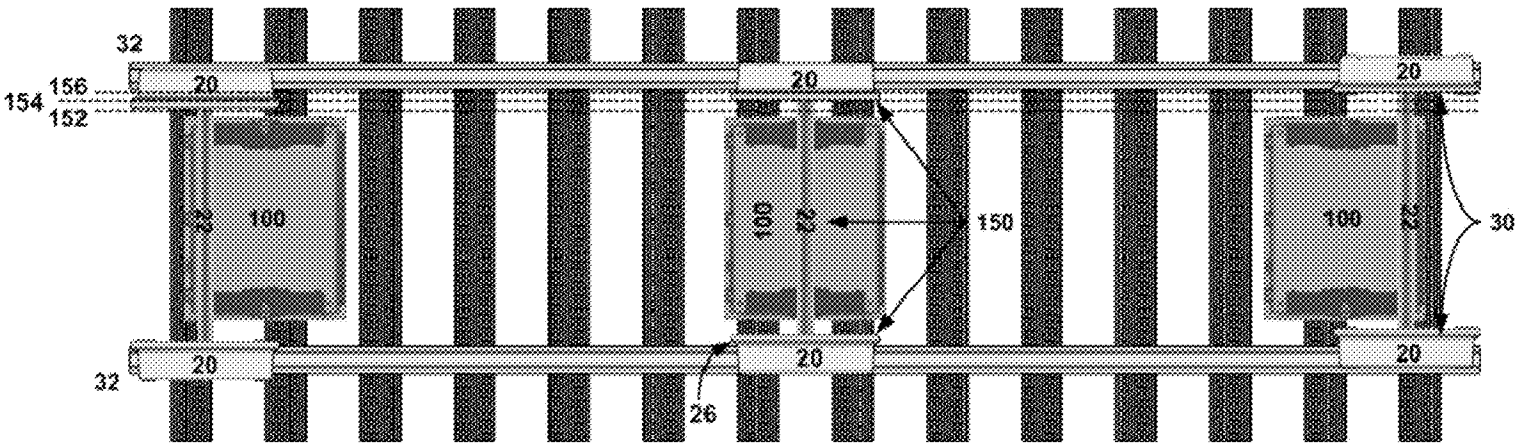
FIG. 5 illustrates a process of capturing hunting behavior by a wheelset according to an embodiment.

Hunting, as described herein, is a slow side to side motion of the wheelsets on the rail 32. FIG. 5 shows multiple views of a single wheelset 150 of two wheels 20 and an axle 22 passing by three components 100. This wheelset 150 is "hunting" and the components 100 can be spaced approximately ten feet apart in FIG. 5. As the wheelset 150 travels along the rail 32, it moves successively to one side—up, in the reference frame of FIG. 5, transversely across the rail 32—as more clearly shown by the lines 152, 154, and 156. These lines 152, 154, and 156 correspond to the location of the gauge-side face 30 of one wheel 20 as it travels along the rail 32 and past each of the components 100. The motion of the wheelset 150 is constrained by the wheel flange 26, such that the wheelset 150 will then reverse its drift until stopped by the flange 26 of the wheel 20 on the other side of the wheelset 150. These oscillations are "hunting" and generally occur over distances of ten feet or more.

An embodiment of the present invention, therefore, can detect and measure hunting by evaluating the distance the wheelset 150 moves from side-to-side across multiple spaced measurements.

Figure 6:
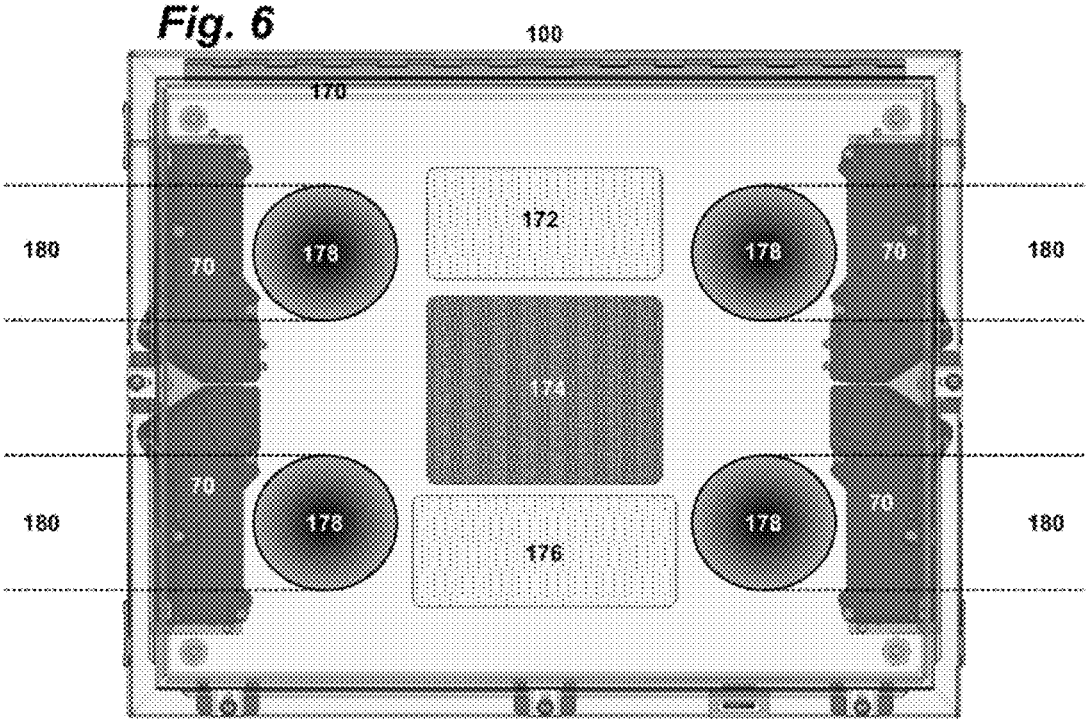
FIG. 6 illustrates a component of a system according to an embodiment.

To this point, the discussion of the component 100 has depicted the component 100 as including the imaging components 70 (FIG. 2) and a rugged casing. However, in actual use, the system can include additional devices to operate and perform the actions described herein. FIG. 6 illustrates this in concept. The component 100 is shown including a rugged casing 170, a data collection unit 172, a power and control module 174, and a communications module 176.

The data collection unit 172 may comprise a computing device merely configured to gather the raw data and pass it to the communications module 176 for transfer to another computer system for analysis as described herein. However, the data collection unit 172 may also include data processing capabilities in hardware and be provided with software to perform some or all the analysis described herein on the data in real-time on location. In an embodiment, such hardware could be a focused image-processing system such as the Gumstix Overa™ line, a PC-104 based board computer, or any other hardware solution appropriate for this application and known to those skilled in the art. As mentioned, the raw data could also be sent to a remote processing system of any appropriate type, which can perform some or all of the processing and/or analysis described herein.

The power and control module 174 distributes power to all other devices in the component 100, and also can be designed to control the overall operation of the component 100. For example, the signals from the wheel switch 108 (FIG. 3) may be registered by the power and control module 174 and cause the remaining devices in the component 100 to be powered up and/or triggered for data collection.

The communications module 176 can transfer data from the component 100, and may do so either via a wired or wireless communications method. The data transfer may include the raw data gathered by the sensing units 70, results of partial or completed analysis performed onboard by the data collection unit 172, and/or the like. Communications may be two-way to permit direct control, evaluation, upgrades, or testing of the component 100.

Physical channels 178 are also shown, connected to conduits 180. These conduits 180 may carry air (e.g., for temperature control, the prevention of contamination, and/or the like), wiring, hydraulic lines, and/or other required components to allow operation of the component 100. For example, wiring may come through such a conduit 180 and channel 178 to provide power to the power and control module 174, to provide a wired connection for communications module 176, and/or the like.

FIG. 7 shows an embodiment in an operational setting. In this embodiment, the component 100 is shown protected by two guard ramps 200, which are designed to withstand reasonable levels of impact, and guide dragging equipment over the top of the component 100 rather than allowing it to strike the side of the component 100. A vent conduit 202 is shown included, which permits the venting of air during heating or cooling operations and may include pipes to drain water which can accumulate beneath the component 100.

In addition, a bungalow 204 is shown. The bungalow 204 may contain data processing equipment (e.g., one or more computing devices), power supplies, controls, and/or other systems to assist in operating the component 100, to assist in maintenance and calibration, to make use (e.g., initiate an action) of the data collected (and possibly analyzed) by the component 100, and/or the like. Trains 206 will pass over the component 100 and their wheel alignments evaluated. Wheel switches 108 can trigger and time the activation of this imaging-based evaluation. Other wheel switches 108 can be placed farther down the track 32 in both directions to allow the devices of the component 100 to be able to "wake up" after going into a power-saving "sleep" mode when no new cars have appeared after some time.

The communications module 176 (FIG. 6) in the component 100 may communicate to the computer system(s) in the bungalow 204, e.g., by wired connections through conduits 180. However, it is understood that wireless communication links 208 may also be used.

FIG. 8 shows a conceptual flowchart of operation according to an embodiment, which can be implemented by one or more computing devices in the component 100, the bungalow 204, and/or the like. Initially, the system can begin in a "sleep" mode, in which many of the devices are partially or entirely powered off. In action 230, a remote sensor detects the approach of a train (or other consist), and in response, in action 232, the system is powered up and prepared. In response to a triggering sensor detecting a wheel in the proper position in action 234, the system will obtain wheelset images in action 236. In action 238, these images can be prepared by filtering, averaging, or other means to ensure they are of sufficient quality for analysis as described herein. In action 240, the images are evaluated. In action 242, a decision can be made based on the evaluation as to whether the wheelset is in an acceptable condition or not. If the images indicate that there are one or more anomalies present, which are outside of the prescribed limits of the target conditions (e.g., hunting, angle of attack, and/or the like), in action 244, an alert for these anomalies can be generated. In either event, in action 246, the wheelset data can be recorded, and the process can return to action 234 to wait for a triggering wheel sensor.

If a triggering wheel sensor is not detected in action 234, in action 248, the time passed can be evaluated to determine whether the time has exceeded a "sleep" time threshold for the system. If it has not, the process returns to action 234 to wait for the triggering sensor. If the sleep time threshold has been exceeded, in action 250, the system checks to see if an inbound car/wheel has been detected which has not yet been evaluated. If such an inbound car/wheel has been detected, the process returns to action 234 to continue to wait for a triggering sensor. If no remaining inbound signals have been detected, in action 252, the system goes to sleep and the process returns to action 230, in which a very low-level sensor evaluator monitors whether the remote sensor wheel is activated.

It is understood that this description is not exhaustive and embodiments can include any and all modifications, additions, derivations, and so on which would be evident to one skilled in the art.

The invention described herein is not limited to the specific form of the embodiments described herein, but can be instantiated in many different forms. Following are some examples of other embodiments.

One embodiment can involve installing the two imaging systems 70 in separate components, rather than in a single component 100. In this case, each component can be located on the outside of the tracks, to image the field side of the wheel rather than the gauge side of the wheel. This embodiment can place the devices in the components generally out of range of impacts from dragging equipment on the trains 206 and can make installation and maintenance much easier. For example, there may be no need to impede through traffic during installation, replacement, or maintenance work. In this case, use of lasers 76 of superior focus and/or higher power may be required, and would expose the cameras 74 to additional ambient light which would not be present underneath a rail vehicle. Possible human exposure to the lasers 76 may also be a concern, although mounting height and the fact that the lasers 76 would only be operative when rail vehicles (e.g., as part of a train 206) are passing (and thus human beings should not be present) may mitigate these concerns.

The foregoing description of various embodiments of this invention has been presented for purposes of illustration and description. It is not intended to be exhaustive or to limit the invention to the precise form disclosed and inherently many more modifications and variations are possible. All such modifications and variations that may be apparent to persons skilled in the art that are exposed to the concepts described herein or in the actual work product, are intended to be included within the scope of this invention disclosure.

What is claimed is:

1. A system comprising:

an imaging component located adjacent to a location of a pair of rails, wherein the imaging component is configured to concurrently acquire image data for opposing wheels on a railcar wheelset as the wheels travel along the pair of rails; and a computer system configured to evaluate the railcar wheelset by performing a method comprising:

deriving three dimensional space coordinates of a plurality of image data points corresponding to at least two distinct portions of each of the opposing wheels from the image data;

fitting a plane to the three dimensional space coordinates of each of the opposing wheels; and calculating a plurality of wheel alignment measures for the railcar wheelset, the plurality of wheel alignment measures including an angle of attack and a tracking position for each of the opposing wheels.

2. The system of claim 1, wherein the railcar wheelset is one of a pair of railcar wheelsets of a truck, and wherein the computer system is further configured to calculate at least one truck alignment measurement for the truck using the plurality of wheel alignment measures for each of the pair of railcar wheelsets of the truck.

3. The system of claim 2, wherein the at least one truck alignment measurement includes at least one of: inter-axle misalignment, tracking error, truck rotation, or shift.

4. The system of claim 1, further comprising a plurality of additional imaging components spaced from the imaging component along the pair of rails, wherein each of the plurality of additional imaging components is configured to concurrently acquire image data for the opposing wheels on the railcar wheelset as the wheels travel along the pair of rails, and wherein the computer system evaluates the railcar wheelset using the image data for each of the plurality of additional imaging components.

5. The system of claim 4, wherein the method further includes evaluating the wheelset for hunting based on the railcar wheelset evaluations using image data from all of the imaging components.

6. A system for evaluating a railcar wheelset for rail alignment, the system comprising:

a set of cameras configured to acquire image data of a portion of a wheel rim surface of a wheel of the railcar wheelset as the railcar wheelset travels along rails; and a computer system configured to process the image data to calculate a set of wheel alignment measures by performing a method comprising:

forming Cartesian coordinates of a plurality of image data points on the wheel rim surface of the wheel; and converting the Cartesian coordinates into a set of wheel alignment measures, wherein the set of wheel alignment measures include an angle of attack for the wheel.

7. The system of claim 6, wherein the image data further includes a portion of a rail head surface of a rail on which the wheel is traveling, and wherein the method further includes forming Cartesian coordinates of a plurality of image data points on the rail head surface of the rail, and wherein the converting further uses the Cartesian coordinates of the rail head surface of the rail.

8. The system of claim 6, wherein the set of wheel alignment measures further include a tracking position for the wheel.

9. The system of claim 6, wherein the set of cameras are further configured to acquire image data of a portion of a wheel rim surface of a second wheel of the railcar wheelset, and wherein the set of wheel alignment measures further include an angle attack for the second wheel.

10. The system of claim 9, wherein the plurality of wheel alignment measures further include a back to back measurement for the wheelset.

11. The system of claim 6, wherein the set of cameras includes at least three cameras located along the rail, and wherein the computer system is further configured to evaluate the wheel for hunting using the image data.

12. The system of claim 6, further comprising a set of projectors configured to illuminate the portion of the wheel rim surface with light having an orientation which is substantially orthogonal to the rail.

13. The system of claim 12, wherein the set of projectors includes at least one laser line projector configured to project a set of substantially vertical laser lines substantially orthogonal to the rail.

14. The system of claim 12, wherein the set of projectors further illuminate a portion of a rail head surface of the rail, wherein the method further includes forming Cartesian coordinates of a plurality of image data points on the rail head surface of the rail, and wherein the converting further uses the Cartesian coordinates of the rail head surface of the rail.

15. A method for evaluating a railcar wheelset for rail alignment, the method comprising:

processing image data of a railroad wheel of the railcar wheelset traveling along a rail to at least one of: reduce noise in the image data or remove outlier points from the image data;

deriving three dimensional space coordinates of a plurality of image data points corresponding to at least two distinct portions of the railroad wheel from the processed image data;

fitting a plane to the three dimensional space coordinates;

comparing an alignment of the fitted plane with a plane of the rail;

determining whether the alignment of the fitted plane is within an acceptable variation parameter for wheel alignment of the railroad wheel with the rail; and determining whether any of a set of wheelset alignment conditions is present based on the wheel alignment of the railroad wheel with the rail.

16. The method of claim 15, further comprising:

illuminating the portion of the rim surface of the railroad wheel as the railcar wheelset travels along the rails, wherein the illuminating includes projecting a plurality of laser lines substantially vertical and orthogonal with respect to the rail on which the railroad wheel is traveling, and wherein the laser lines are projected onto a gauge side of the railroad wheel; and acquiring the image data for the railroad wheel during the illuminating.

17. The method of claim 16, wherein the acquiring image data includes capturing at least three images of the railroad wheel during the illuminating, and wherein the processing includes comparing the at least three images to remove outliers from consideration and to determine any variation due to at least one of: misalignment or warping of the railroad wheel.

18. The method of claim 16, wherein the illuminating and acquiring are performed a plurality of times for the railroad wheel as the railroad wheel travels along the rail, the method further comprising determining whether the railcar wheelset is hunting based on the image data acquired the plurality of times.

19. The method of claim 15, wherein the actions are performed for both railroad wheels on the railcar wheelset.

20. The method of claim 19, further comprising determining a back to back measurement for the wheelset, wherein the determining whether any of the set of wheelset alignment conditions is present is further based on the back to back measurement.

* * * * *